US005106118A

United States Patent [19]

Frey

[11] Patent Number: 5,106,118

[45] Date of Patent: Apr. 21, 1992

[54] PROTECTIVE LAYER FOR PREVENTING THE BUILDUP OF ICE AND SNOW ON A SKI BINDING

[76] Inventor: Gregg W. Frey, 403 E. Greenland Ave., Oconomowoc, Wis. 53066

[21] Appl. No.: 465,396

[22] Filed: Jan. 16, 1990

[51] Int. Cl.[5] ..... A63C 9/00

[52] U.S. Cl. ..... 280/636; 280/809; 428/80; 428/99; 428/138

[58] Field of Search ..... 280/809, 636; 428/80, 428/131, 99, 138

[56] References Cited

U.S. PATENT DOCUMENTS 4,657,279 4/1987 Pascal et al. ..... 280/636

4,869,525 9/1989 Gallet et al. ..... 280/636

FOREIGN PATENT DOCUMENTS 642268 4/1984 Switzerland ..... 280/809

*Primary Examiner*—Alexander S. Thomas

*Attorney, Agent, or Firm*—Russell W. Illich

[57] ABSTRACT

A one piece layer is provided for protecting the flat surface of a cross-country or telemark ski binding. The layer is a single die-cut self-adherent film to precisely fit the binding plate. The layer is made of a non-stick material such as teflon or polyethylene with one side of the layer made of a high-tack silicone or arcylic adhesive to attach the layer to the binding. The exterior non-stick surface of the layer provides a most effective means for preventing snow and ice buildup on the binding plate and includes a means of covering the heads of the ski binding mounting screws.

7 Claims, 1 Drawing Sheet

PROTECTIVE LAYER FOR PREVENTING THE BUILDUP OF ICE AND SNOW ON A SKI BINDING

BACKGROUND OF THE INVENTION

The present invention relates to the prevention of the buildup of ice and snow upon ski bindings. The problem of ice and snow buildup on ski bindings is most common in cross-country skiing where the heel of the ski boot is not secured to the ski which allows snow to enter the space between the ski and the sole of the boot. Snow and ice generally doesn't accumulate to any degree upon the ski itself because the surface of the ski is usually formed of a non-stick material or is coated with some type of smooth non-stick finish. However, the ski binding is not immune to the buildup of snow and ice due to its general manufacture of metal. Since snow can stick to metals such as aluminum or steel, there is often a buildup of ice that occurs on cross-country or telemark bindings. This buildup can be very annoying for a skier who must either stop frequently and scrape the ski bindings clean or continue to ski with the discomfort of a layer of ice and snow between the boot and binding.

There have been several attempts at alleviating the problem of ice buildup on bindings but these prior art methods and devices have generally fallen short of an ideal way of preventing the buildup.

One way that a non-stick finish is applied to bindings is by spraying some type of paint, silicone, or enamel coating on the binding. This method suffers from a number of disadvantages. First, these coatings will usually wear quite quickly forcing a skier to re-apply the coating frequently. Second, if the coating is clear, it is often difficult to determine whether a new coat should be applied before the actual buildup of snow and ice indicates the need for re-application. Third, the spray cannot cover the rough spots revealed by the mounting screws of the binding. So even if the entire binding is sprayed, ice can still buildup at the screw heads and spread out across the rest of the binding. Finally, spraying is an inefficient way to provide the non-stick surface. If dust or dirt is in the air or on the binding, the dust will adhere to the finish causing rough spots to occur on the binding which may attract snow and ice.

Another way to prevent ice buildup on bindings has been achieved by application of strips of tape or adhesive pads that are cut and applied to the surface of the binding. With this method the screw heads of the binding may be covered. However, this method also suffers from a number of disadvantages. First, the skier must go through the steps of cutting the tape or pad to form to the ski binding. This proces can get quite lengthy when exact holes must be formed within the tape or pad to allow the ski boot projections of the binding to rise above the surface of the tape or pad. Another disadvantage of applying multiple pieces of tape or pads is that the peripheral edges of each piece have the potential of losing their adherence to the binding. With the vigorous activity of the boot upon the binding that is required in cross-country skiing, the peel back of the tape or pad from the binding is very possible and would result in ice or snow buildup in the exposed areas.

The prior art methods of preventing ice and snow buildup on ski bindings have failed to provide an easy-to-use and effective way for a user to alleviate the buildup problem.

SUMMARY OF THE INVENTION

It is an object of this invention to provide a device that is easy-to-use and effective in preventing the buildup of ice and snow on a ski binding.

Another object the invention is to provide a device that covers the entire flat surface of the binding plate including the heads of the mounting screws of the binding.

It is a further object of the invention to provide a device that is economical to manufacture, flexible in use, and aesthetically appealing in design.

Other objects of the invention will be apparent hereinafter from the specification and from the recital of the appended claims, particularly when read in conjunction with the accompany drawings.

The present invention comprises a one piece layer for protecting the flat surface of a cross-country or telemark ski binding. The layer is a single die-cut self-adherent film to preciesely fit the binding plate. The layer is made of a non-stick material such as teflon, UHMW polyethylene, or similar polyolefin polymer on one side of the layer with a high-tack silicone or acrylic adhesive on the opposite side. The exterior non-stick surface of the layer provides a most effective means for preventing snow and ice buildup on the binding plate and includes a means of covering the heads of the ski binding mounting screws.

DETAILED DESCRIPTION OF THE INVENTION

Figure 1:
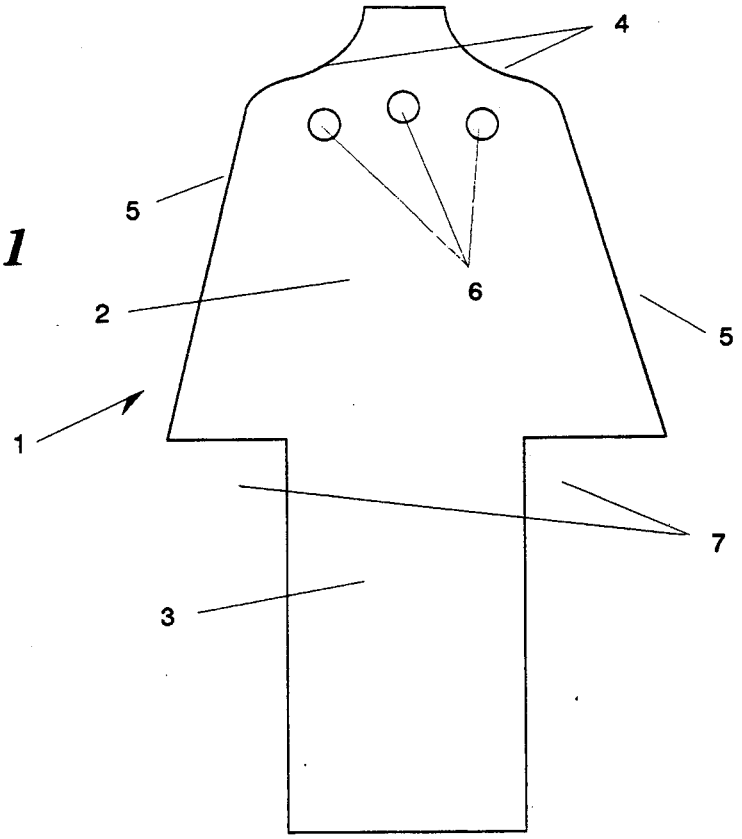
FIG. 1 shows a plan view of a preferred embodiment of the protective layer.

FIG. 1 shows an outline view of the protective layer 1. The layer includes a widened toe portion 2 and a narrow sole portion 3 which cover the entire flat surface of a ski binding plate. The toe portion includes rounded shoulders 4 that join with straight sides 5 on either side of the toe portion. The shoulders 4 and straight sides 5 define the outer contour of the layer which conform to the sides of the binding plate, as will be explained below. The toe portion also includes pre-formed holes 6 that conform to three projections on conventional cross-country ski bindings. These projections fit with three holes on the underside of the toe of a ski boot to fasten the toe of the boot to the binding. The pre-formed nature of the holes and the outer contour allow the layer to be used without any modification.

The sole portion of the layer includes a pair of cutouts 7 on either side where the sole portion 3 integrally connects with the toe portion. The layer is not vertically symmetrical. The cutout on the right side of the layer is slightly wider than the cutout on the left side of the layer. Most conventional bindings are nonsymmetrical, so the shape of the layer corresponds to either a left binding plate or a right binding plate, as shown. The narrow nature of the sole portion corresponds to the narrow outline of conventional ski bindings. The exact borders of the entire layer serve two purposes. First, the border allows the layer to aesthetically cover the binding without covering any part of the ski. Second, the single border allows for only a single exposed edge of the layer. The exposed edge is to the side of the boot in the toe region and below the boot in the sole region. Thus, the lifting of the boot up and down upon the binding plate, which occurs within cross-country skiing, has no effect upon the edges of the layer 1. This alleviates the problem of cut pieces of tape or pad peeling back caused by the up and down motion of the ski boot upon the binding plate.

Figure 2:
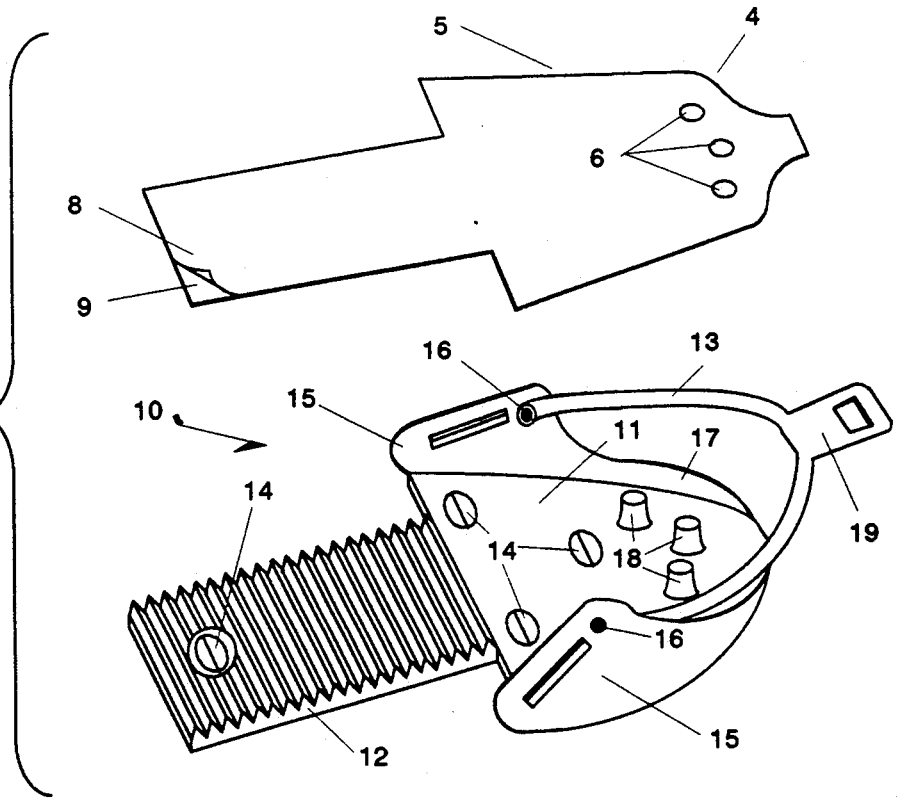
FIG. 2 shows a perspective view of the protective layer of FIG. 1 and a ski binding to which the layer is applied.

FIG. 2 shows a combined perspective view of the layer and a conventional ski binding. The layer 1 includes a protective film 8 which covers the adhesive side 9 of the layer until the layer is to be applied to the binding.

The binding 10 includes a toe plate 11 connected to a sole plate 12. A toe bar 13 is hinged to the toe plate and fastens the tip of a ski boot to the plate 11. The toe plate and sole plate are formed as one piece and are fastened to the skis by flathead screws 14. The heads of these screws 14 can attract snow and ice buildup if not covered by a device such as the layer of the present invention.

The toe plate 11 further includes upright flanges 15 that provide a mounting surface for hinges 16 to pivotably mount the toe bar 13. The flanges usually include a curved section 17 at their ends as shown in FIG. 2. The toe plate also includes three standard projections 18 which project upwardly from the plate and cooperate with holes on the underside of the toe of a ski boot (not shown). Once the ski boot is fit over the holes, the toe bar 13 is brought down over the tip of the boot and a tongue 19 of the bar 13 is fastened to some type of latch member (not shown) to secure the boot to the plate.

The ski binding 10 shown in FIG. 2 is of a conventional nature, but the shape of the flanges and the nature of the latch mechanism can vary on bindings from different manufacturers.

The layer 1 is applied to the binding by peeling the film 8 from the adhesive back 9 of the layer. The layer is then brought down onto the toe and sole plates 11 and 12 of the binding. The holes 6 of the layer fit over projections 18 of the toe plate. All other features of the flat surfaces of the toe and sole plates are covered by the layer. The layer is shown with curved shoulders 4 and straight sides 5 which would extend up onto the curved flange 15 of the toe plate. It should be noted that some bindings have flanges that include a curved portion (as denoted by the numeral 17) and a straight portion to mount the toe bar instead of the continuous curved flange 15 shown in FIG. 2. The contour of the layer 1 can either be formed oversized to extend up along a portion of the upright flange 15, or be provided with a number of different pre-cut sizes and shapes to extend only to the edge of the flange 15.

The layer covers the entire flat surface of the plate providing a non-stick surface similar to the non-stick finish of conventional cross-country skis. The layer may be made of Teflon TM, polyethylene, or similar polyolefin polymers. These types of materials have low coefficients of friction which prevent snow or ice from accumulating on the layer. The preferred material is one of low modulus such as Teflon because it tends to seal better against the screw heads than other stiffer materials such as UHMW which tend to lift off over time. The adhesive may be a high-tack silicone or acrylic adhesive. High-tack silicone is the preferred adhesive because an acrylic adhesive is prone to brittleness at low temperatures which leads to premature failure of the layer. The ideal thickness of the layer falls within a range of 0.005–0.015 inches.

The one piece protective layer provides a unique device and method for preventing the buildup of ice and snow between a binding and ski boot. The continuous layer covers binding screws that lead to the interior of the ski. Thus, the layer protects the ski from damage that may occur from ice and snow entering the ski through and around the screw hole. The layer protects the surface of binding from abrasion and other types of wear. Additionally, the plastic material of which the layer is made deadens noise associated with the conventional metal parts of the ski binding.

It should be apparent that many modifications could be made to the layer which would still be encompassed within the spirit of the present invention. It is intended that all such modifications may fall within the scope of the appended claims.

What is claimed is:

1. A protective layer in combination with a ski binding plate having a toe plate, a sole plate, and at least one mounting screw extending through a screw hole, said protective layer comprising:

a one piece layer of material having a first side and a second side, said first side having a low coefficient of friction to prevent the attachment of snow upon said layer, said second side having a means of attaching said layer to the binding;

wherein, said layer is attached to the binding plate and covers the entire binding plate in a continuous manner and prevents the buildup of snow anywhere on the binding plate.

2. A protective layer in combination with a ski binding plate as claimed in claim 1, wherein, said layer covers said at least one mounting screw of the binding plate in a continuous manner and prevents the entrance of moisture beneath the binding plate by sealing said screw hole from the atmosphere.

3. A protective layer in combination with a ski binding plate as claimed in claim 1, wherein, said layer has a widened toe portion for covering said toe plate of the binding and a narrowed sole portion for covering said sole plate of the binding, said toe portion having an outer contour of substantially the same shape as the contour of said binding toe plate.

4. A protective layer in combination with a ski binding plate as claimed in claim 1, wherein, said layer is made of a flexible film and provides a means to protect the binding from abrasion and wear.

5. A protective layer in combination with a ski binding plate as claimed in claim 1, wherein, said layer is made of a flexible film and provides a means to deaden noise around the binding plate.

6. A protective layer in combination with a ski binding plate as claimed in claim 1, wherein, said ski binding plate is of a cross-country ski binding type.

7. A protective layer in combination with a ski binding plate as claimed in claim 6, wherein, said cross country ski binding plate comprises three projections extending upwardly from said ski binding plate, said layer further comprises three holes within said toe portion, said holes for fitting over said three projections extending up from the binding plate.

* * * * *